US005082288A

United States Patent [19]

Swartz

[11] Patent Number: 5,082,288

[45] Date of Patent: Jan. 21, 1992

[54] DICE GAME SIMULATING HORSESHOE PITCHING

[76] Inventor: Elmer L. Swartz, 9490 Harbor Greens Way, #C-203, Seminole, Fla. 34646

[21] Appl. No.: 710,511

[22] Filed: Jun. 4, 1991

[51] Int. Cl.[5] ..... A63F 3/00; A63F 9/04

[52] U.S. Cl. ..... 273/244; 273/285; 273/287; 273/145 B; 273/146

[58] Field of Search ..... 273/145 B, 145 R, 146, 273/309, 287, 244–247, 285, 282 R, 274

[56] References Cited

U.S. PATENT DOCUMENTS

| | | | |
|---|---|---|---|
| 993,392 | 5/1911 | Miller | 273/145 B |
| 3,468,543 | 9/1969 | Dove | 273/145 R |
| 4,094,509 | 6/1978 | Barron | 273/247 |

FOREIGN PATENT DOCUMENTS

| | | | |
|---|---|---|---|
| 606857 | 6/1926 | France | 273/145 B |
| 2217613 | 11/1989 | United Kingdom | 273/244 |

*Primary Examiner*—Benjamin Layno
*Attorney, Agent, or Firm*—David Kiewit

[57] ABSTRACT

A game comprising board apparatus and dice is taught for simulating the well known outdoor game of horseshoe pitching. To play the game each of two players drops two color-coded dice down a chute onto a board where indicia on the upper surface of each resting die indicates one of a set of possible results of a horseshoe pitch. Sometimes a dropped die will change the score indicated by an earlier dropped die, just as a later pitched horseshoe may change the scoring position of an earlier pitched horseshoe. Score keeping for the game follows the rules for horseshoes, save for the special requirement that an exact score is needed to win. In a preferred embodiment of the invention, several pegs and a sequence of numbered holes are provided adjacent the game board to aid in score keeping.

5 Claims, 3 Drawing Sheets

DICE GAME SIMULATING HORSESHOE PITCHING

BACKGROUND OF THE INVENTION

The present invention provides a board game that simulates the well known game of horseshoe pitching and that uses dice to select among the many possible outcomes of a pitch.

A number of games have been invented that employ dice, spinners, shuffled decks of option cards, or other random number generators to select a play option in a board game that simulates a sport or other game. In U.S. Pat. No. 4,501,426, for example, Seitz provides a simulation of the game of bowling in which both dice and cards are employed to select possible outcomes of the action of rolling a bowling ball down a lane toward an array of pins. Similarly, U.S. Pat. No. 4,822,043 provides a simulation of the game of baseball in which cards are used to select statistically likely play results. In like manner, U.S. Pat. No. 4,241,924 teaches a simulation of olympic sports, U.S. Pat. No. 4,106,774 teaches a simulation of golf via the use of polyhedral dice, while U.S. Pat. Nos. 4,093,238, 4,060,246, and 3,951,412 all teach means of simulating horse racing. Clearly, a great number of selections is possible both in choosing a game or sport to simulate and in selecting the exact method of simulation.

Board games that use dice, such as the well known and ancient game of backgammon, often use small cups, boxes or other mixing chambers to ensure fair throws of the dice and to prevent a skilled player from controlling the outcome of his toss by holding the dice in his hand and throwing them in a controlled way. Some games provide chutes that the dice are dropped down to mix them. Notable among these games is the one taught by Stackmayr in U.S. Pat. No. 4,557,486, wherein a dice chute that simulates a silo is used both to mix the dice and to display the results of a dice toss in a farming simulation game.

In the great majority of dice games, scoring each throw involves summing the numbers of spots on the top surface of each of a player's dice. Lamie, however, in U.S. Pat. No. 4,743,031, teaches a dice game in which the outcome of a round of the game is determined by a process that involves, inter alia, matching the indicia on dice thrown by competing players.

One popular outdoor game that has heretofore not been simulated as a board game is that of horseshoe pitching. The players in this game take turns throwing horseshoes at a peg in the ground that is 40 feet away. Horseshoes that come to rest within 6 inches of the peg are eligible for scoring, and may count .or one point. Horseshoes that come to rest so that the peg is inside the arc of the shoe are called "ringers", and may be worth three points. Subsequently thrown horseshoes may move a previously thrown shoe either into or out of a scoring position. After each of two player has thrown a pair of horseshoes, the positions of the shoes are noted, and the turn is scored using a cancellation algorithm.

SUMMARY OF THE INVENTION

The preferred embodiment of the invention comprises a board game with a rectangular enclosed region, simulating the pit around a horseshoe peg, in which the dice land. A dice chute is mounted onto one wall of the enclosure, and arrays of scoring holes (in which scores are indicated by placing small pegs) are provided on two of the other three walls. The players take turns dropping specially marked dice down the dice chute to simulate horseshoe pitches. The dice have indicia on their surfaces to denote various possible scores such as a ringer (indicated by the letter "X" on a die), a miss (indicated by a blank die face) and a variety of other scoring possibilities (indicated by numbers that represent the distance, in inches, that a horseshoe has landed from the peg).

The rectangular enclosed region aids in the simulation by providing an opportunity for later thrown dice to hit and change the scoring indication of earlier thrown dice, just as a later pitched horseshoe may hit and change the scoring position of an earlier pitched horseshoe. Hence, it is an object of the invention to provide a game that simulates the outdoor game of horseshoe pitching and thereby appeals to those persons who engage in horseshoe pitching and who might desire such a simulation (e.g. during periods of foul weather when the play of outdoor games would be unpleasant).

The system of scoring the game that is taught herein generally matches the cancellation system of scoring used in actual horseshoe pitching. Hence, it is also an object of the invention to provide a game that may be used as an instructional aid in teaching new players how to score the actual game of horseshoe.

It is a further object of the invention to provide a novel dice game that can be used for competition between two players or between two teams of two players each.

Other features and advantages of the present invention will become apparent from the following description, in word and text, of the inventor's preferred embodiment thereof.

DETAILED DESCRIPTION OF THE PREFERRED EMBODIMENT

Figure 1:
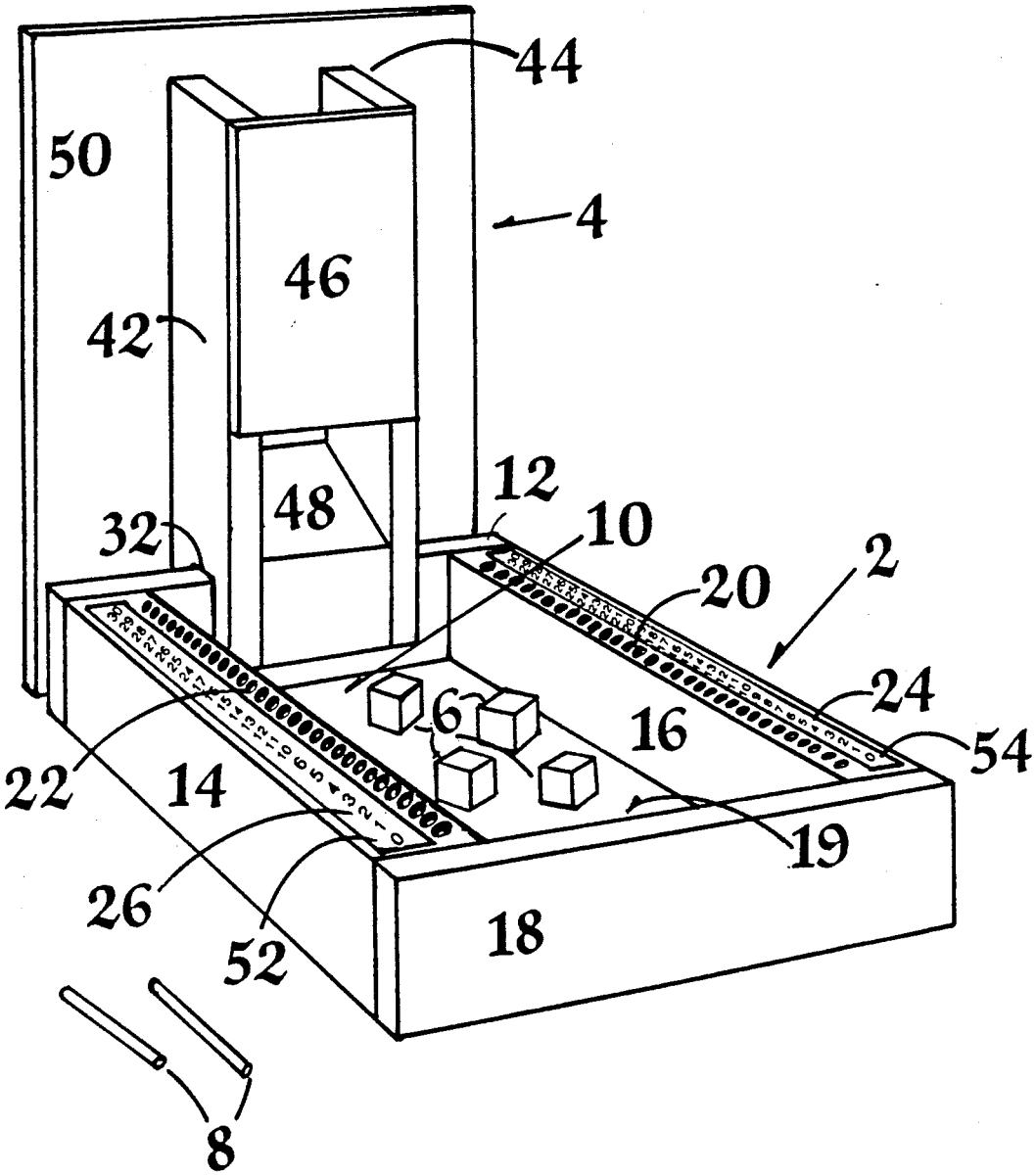
FIG. 1 of the drawing depicts an overall view of the game as it is being played, and shows a way of attaching a dice chute to the walls of a rectangular enclosed dice landing area.

Turning now to FIG. 1 of the drawing, one sees game board apparatus comprising a base unit 2, a lid and chute unit 4, dice 6 and scoring pegs 8.

The base unit 2 comprises a rectangular dice landing area 10, which is defined by the four walls 12, 14, 16, and 18, and a bottom surface 19. Linear arrays 20, 22 of holes are provided on the top surfaces 24, 26 of two of the walls 14, 16. These arrays of holes are used with associated arrays of numbers for the purpose of recording scores, as will subsequently be discussed.

When the game is played, the base unit 2 is placed on a horizontal surface, and the lid and chute unit 4 is mounted, by means of a slot 32, onto one of the walls 12 of the base unit 2, whereby the lid and chute unit 4 assumes a generally vertical position.

A chute 40, comprising side walls 42, 44, wherein mounting slot 32 may be formed, a front wall 46, and a dice deflecting block 48, is attached to, or formed integrally with, the lid 50 portion of the lid and chute unit 4.

FIG. 1 of the drawing shows a base unit 2 and lid and chute assembly 4 that are fabricated from separate pieces of wood or other suitable material. In keeping with this construction method, arrays of scoring numbers are illustrated as having been printed on labels 52, 54 that are adhered to the tops of walls 14 and 16, adjacent arrays 20, 22 of holes. In a preferred embodiment, the arrays 20, 22 consist of thirty one holes each, and the numerals printed on the labels 52,54 correspondingly cover the range from zero to thirty.

It will be appreciated by those skilled in the art of plastic component manufacture that an equivalent structure, providing all the essential features of the base unit 2, and having arrays of holes and numbers integrally formed on the top surfaces 24,26 of walls 12,14 could be made by a molding process. Similarly, the chute and lid unit 4, which is shown in FIG. 1 as having been made from five separate pieces of material, could be formed by a plastic molding process that would provide its essential features with integrally formed surfaces and enclosures.

Figure 2:
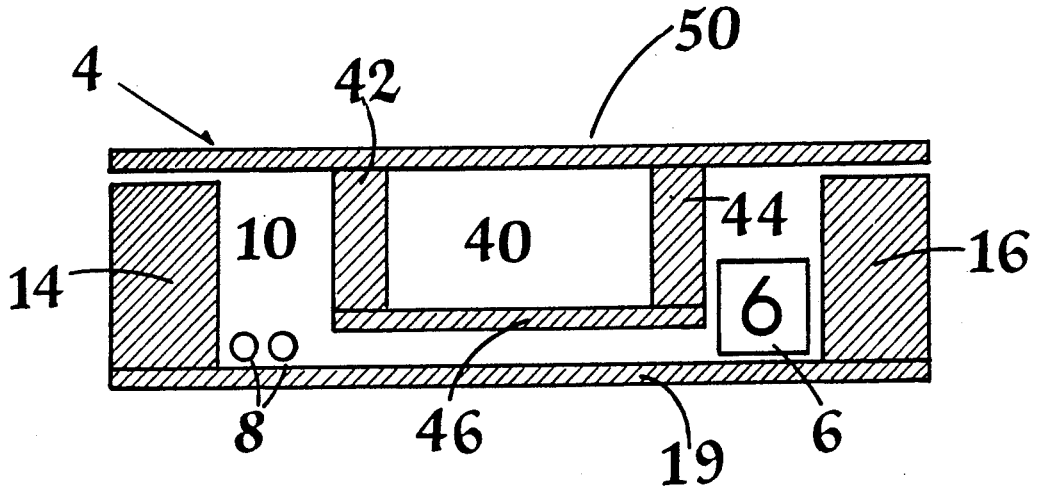
FIG. 2 of the drawing is a cross-sectional view that shows how the two main pieces of the game interlock to form a storage box for the game when it is not in use.

Turning now to FIG. 2 of the drawing, one can see, by means of the cross-sectional view of that figure, the way in which the game is stored when not in use. The dice 6, and scoring pegs 8 are placed in the rectangular dice landing area 10. The lid and chute assembly 4 is removed from the wall 12 and placed over the top of the base unit 2 to close the game for storage. The exterior dimensions of chute 40 are chosen to provide adequate space between a side 42 or 44 of the chute and one of the walls 14,16 of the base unit so that there is room to store both the dice 6 and scoring pegs 8.

Figure 3:
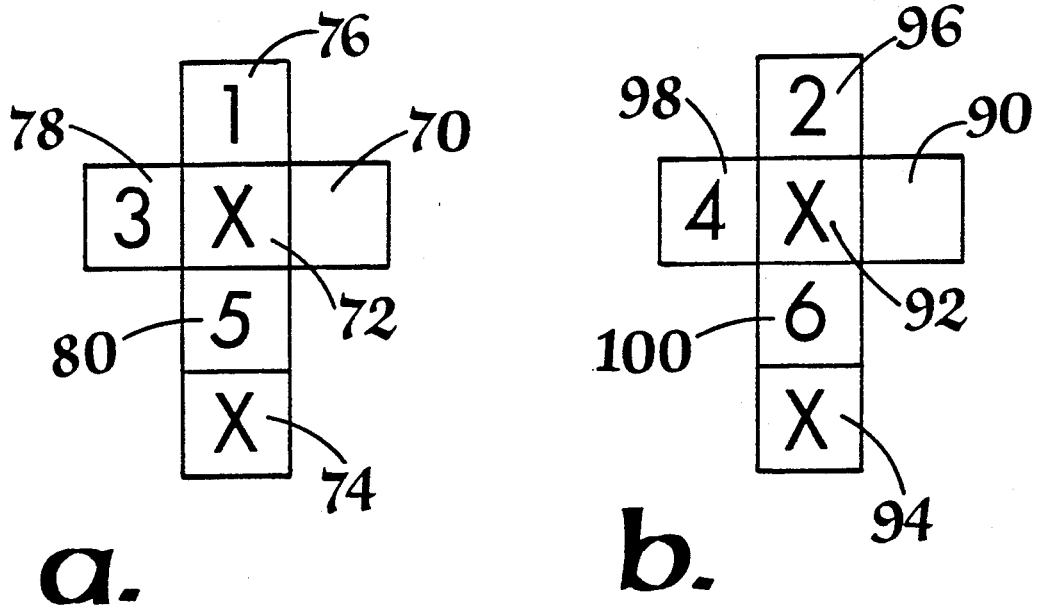
FIG. 3 of the drawing illustrates the preferred markings used on the dice that are a part of the game.

The dice 6 that are preferably used in the game have unique markings, as illustrated in FIG. 3 of the drawing. In order to illustrate all six sides of each of the two dice that form a player's set, FIG. 3 has been prepared as an "unfolded" view wherein the viewer is asked to imagine that each die consists of a cubical box made by folding a paper sheet, rather than being a solid cube. The box is then opened and unfolded so as to reveal all six sides in the single plan view of FIG. 3. One die in each player's set, as shown in FIG. 3*a*, has one blank surface 70, two surfaces 72,74 with an "X" (symbolizing a ringer), and three other surfaces 76,78,80 whereon the numerals "1", "3" and "5" are displayed. The other of the two dice in a player's set, as shown in FIG. 3*b*, has one blank surface 90, two surfaces 92,94 bearing an "X" and three surfaces 96, 98, 100 bearing the numerals "2", "4" and "6" respectively. The complete set of dice 6 comprise two players' sets, and these two sets are distinguished by color so that one player, e.g., may have dice that have black indicia imprinted on a white background, while the other player may have dice bearing red indicia imprinted on a white background.

It is noted that although the preferred embodiment of the game involves the use of cubic dice with a specific set of indicia, other combinations of indicia (e.g. differing numerals could denote another of the infinitude of possible combinations of distances, or could indicate a distance measured in centimeters) could be used on the dice. Also, as is well known in the art of dice games, one could employ non-cubic, polyhedral dice having a different number of facets, whereby one could provide different sets of simulated scoring distances.

A set of scoring pegs 8 is provided with the game. During play, each player is assigned one of the scoring hole arrays 20, 22, and may keep track of his score by placing one of these pins in the appropriately numbered one of the holes in his assigned array. At the beginning of each game, each player places his scoring peg in the "0" hole of his array.

During play, one of the players drops his dice, one at a time, down the chute 40. The second player then does the same. After all four dice are dropped, the score is determined from the indicia on the top surfaces of the dice according to the cancellation scoring algorithm that is used in the game of horseshoe pitching and that is illustrated as FIG. 4 of the drawing.

Figure 4:
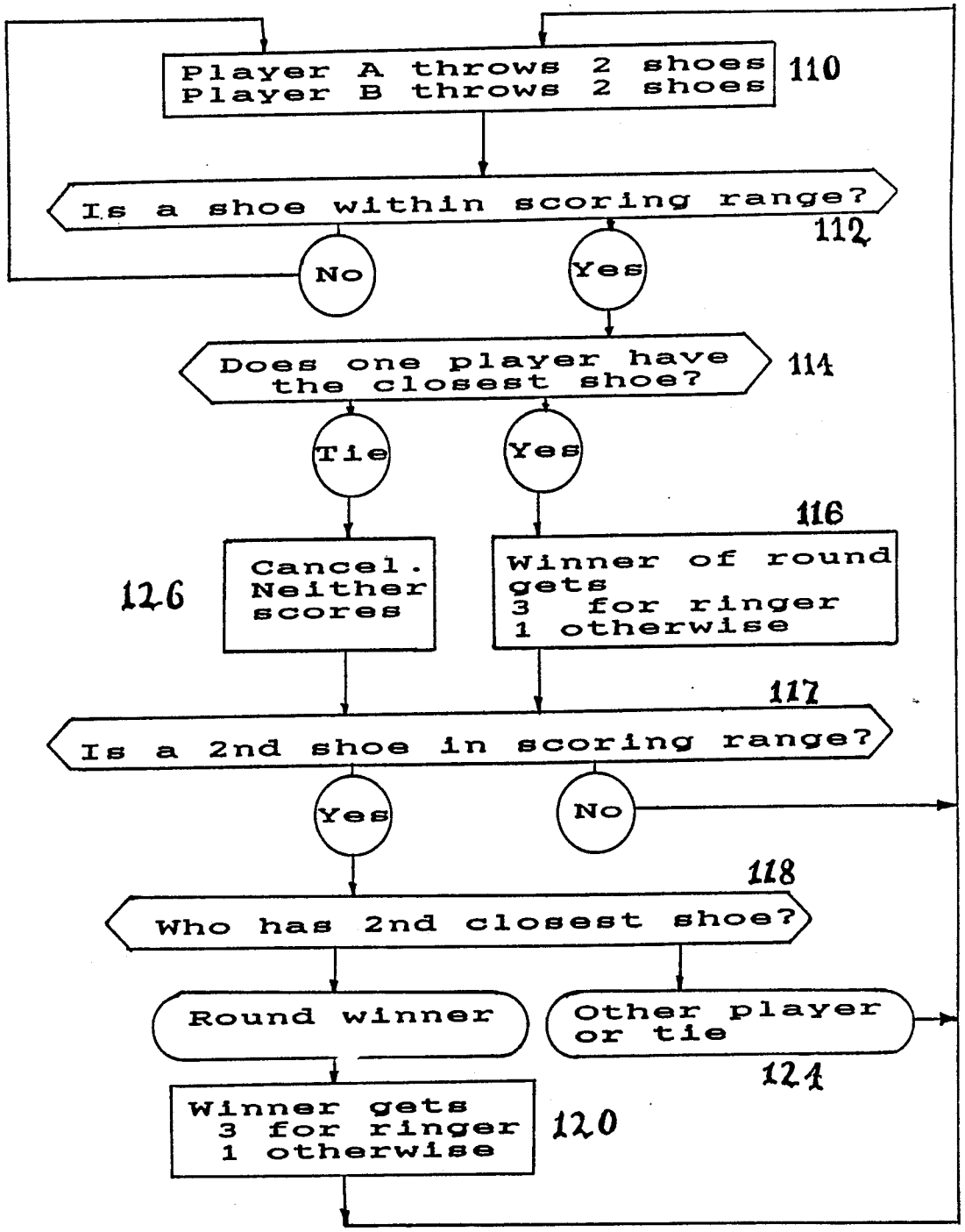
FIG. 4 of the drawing presents, by means of a flow chart, the cancellation scoring algorithm that is employed both in the actual game of horseshoe pitching and in the subject game.

In the horseshoe scoring algorithm for one round of play, as shown in FIG. 4, two players, labelled "A" and "B" throw horseshoes (in Step 110) and then determine (in Step 112) if any horseshoe is within scoring range. If not, the game moves to the next round. If one or more shoe is within scoring range, one then determines (in Step 114) which shoe is closest to the peg. If player A's closer horseshoe is closer to the peg than any of player B's shoes, that horseshoe scores either three points if it is a ringer, or one point if it is not a ringer (Step 116). The scoring then proceeds if a second shoe is within scoring range (Step 117). For example, if A's second horseshoe is closer to the peg than either of B's two shoes (Step 118), then A receives points for that shoe as well (Step 120), and B receives none. If, on the other hand, B's closer shoe is closer to the peg than A's farther shoe, A receives no more points. In this case A's scoring increment for the round consists of the point or points won with his closer shoe, and B receives none. If two opposing horseshoes are at the same distance, they cancel each other, as shown in Steps 124,126.

In the game that is taught in this disclosure, the same algorithm is employed, but distances from the peg (in inches) are represented by the numerals marked on the dice. When scoring indicia on each of a player's dice match the scoring indicia on the other player's dice there is no score for the round. In other cases, the markings on the dice are matched as though they were distances of horseshoes from a peg and the scoring algorithm of FIG. 4 is applied to determine the score for that round.

Scoring of the preferred embodiment of the game differs from the scoring of horseshoe pitching in that a predetermined target score, e.g. thirty points, must be attained for a player to win the game. If a player scores on a given turn, and his score for that turn, when added to his existing point total, would aggregate to more than thirty points, his score on the given turn is nullified so that he must try on his next turn to score either the exact number of points that he needs to reach the thirty point goal, or to score a lesser number of points such that his new score aggregates to less than thirty points.

Modifications and variations of both the preferred rules of this game and of the apparatus provided in the preferred embodiment herein disclosed can be made without departing from the subject and spirit of the invention. For example, the use of molded plastic components, rather than of the wooden pieces used to form the actual game of the inventor's prototype could be used, as discussed above. Alternately, differing arrangements of indicia on the dice could be employed to provide a game having differing probabilities of scoring ringers, misses, etc. Moreover, scoring arrangements differing from the one that is taught could be used. Such modifications and variations are meant to be considered as being within the scope of the invention as described in the following claims.

What is claimed is:

1. Apparatus for a dice game comprising polyhedral dice having indicia on facets thereof, a horizontal surface bounded by vertical walls, a row of holes on the top surface of one of said vertical walls, a vertical dice chute attached to a plane surface member, said vertical dice chute and plane surface member being detachably mounted on a second one of said vertical walls adjacent said horizontal surface, wherein said apparatus has dimensions such that said vertical dice chute and plane surface member, when detached from said second one of said vertical walls and placed horizontally on top of said horizontal surface and said vertical walls, with said dice chute below said plane surface member, said apparatus forms a box having an intramural space therein adequate for the storage of said dice.

2. Apparatus of claim 1 wherein one of said indicia represents a ringer in a game of horseshoes and another of said indicia represents a distance that a horseshoe may land from a peg.

3. Gaming apparatus comprising two pairs of cubic dice wherein one of each of said pair of dice has one blank surface, two surfaces with a first indicium imprinted thereon, and three surfaces that are each imprinted with a unique numeral chosen from a first set of three differing numerals, the other one of each said pair of dice has one blank surface, two surfaces with said first indicium imprinted thereon and three surfaces that are each imprinted with a unique numeral chosen from a second set of three differing numerals, said first set and set second set having no common members, and wherein said pairs of dice are distinguished from each other by the color of the indicia imprinted thereon, a gaming board base unit comprising a flat bottom surface four walls attached to said bottom surface and defining a rectangular dice landing area, wherein two of said walls have linear arrays of numbered holes on their top surfaces, and one of said walls is adapted for the temporary mounting, in a generally vertical attitude, of a gaming board chute unit comprising a flat surface member and a chute mounted thereto, scoring pegs adapted to fit into ones of said linear arrays of numbered holes, said base unit and said chute unit being configured so that they may be closeably fastened together with said flat surface member and said flat bottom surface parallel to each other, with said chute occupying a portion of a rectangular volume defined by said four walls and said top and bottom surfaces and with said four dice and said scoring pegs disposed in a portion of said rectangular volume not occupied by said chute.

4. The apparatus of claim 3 wherein said first indicium is the letter "X", said first set of numerals consists of the numbers 1, 3 and 5, and said second set of numerals consists of the numbers 2, 4, and 6.

5. Gaming apparatus of claim 3 wherein said indicium represents a ringer in a game of horseshoes and said three numerals are chosen to represent distances that a horseshoe may land from a peg.

* * * * *